US007961164B2

(12) United States Patent
Moon

(10) Patent No.: US 7,961,164 B2
(45) Date of Patent: Jun. 14, 2011

(54) SIGNAL PROCESSING DEVICE, LIQUID CRYSTAL DISPLAY HAVING THE SAME AND METHOD OF MANUFACTURING THE SAME

(75) Inventor: Hoi-sik Moon, Cheonan-si (KR)

(73) Assignees: Samsung Electronics Co., Ltd. (KR); Seoul National University Industry Foundation (KR)

( * ) Notice: Subject to any disclaimer, the term of this patent is extended or adjusted under 35 U.S.C. 154(b) by 1118 days.

(21) Appl. No.: 11/688,511

(22) Filed: Mar. 20, 2007

(65) Prior Publication Data

US 2008/0001936 A1 Jan. 3, 2008

(30) Foreign Application Priority Data

Jun. 15, 2006 (KR) ..... 10-2006-0054072

(51) Int. Cl.
*G09G 3/36* (2006.01)

(52) U.S. Cl. ..... 345/89; 345/87; 345/690

(58) Field of Classification Search ..... 345/63, 345/77, 87–89, 690
See application file for complete search history.

(56) References Cited

U.S. PATENT DOCUMENTS

| | | | | |
|---|---|---|---|---|
| 2004/0196274 | A1* | 10/2004 | Song et al. | 345/204 |
| 2005/0062703 | A1* | 3/2005 | Lee et al. | 345/89 |
| 2006/0071927 | A1 | 4/2006 | Chang et al. | |
| 2007/0257874 | A1 | 11/2007 | Kim | |

FOREIGN PATENT DOCUMENTS

| | | |
|---|---|---|
| EP | 1467346 | 4/2008 |
| JP | 2002-323609 | 11/2002 |
| KR | 1020050024048 | 3/2005 |
| KR | 1020050041463 | 5/2005 |

OTHER PUBLICATIONS

European Search Report for application No. 07011306.3-2205/1868179 dated Dec. 1, 2008.
Song et al., "Novel Method for Fast Response Time in PVA Mode"; SID Digest, 2004, pp. 1344-1347.
Kim, "Invited Paper: The World's Largest (82-in) TFT-LCD"; SID Digest, 2005, pp. 1842-1847.

* cited by examiner

*Primary Examiner* — Amare Mengistu
*Assistant Examiner* — Koosha Sharifi
(74) *Attorney, Agent, or Firm* — Cantor Colburn LLP

(57) ABSTRACT

A signal processing device and method of manufacturing the same include a converting unit converting first, second, and third image data into first sub first image data, first sub second image data, and first sub third image data having gray levels higher than the gray levels of first, second, and third image data, respectively, and second sub first image data, second sub second image data, and second sub third image data having gray levels lower than the gray levels of the first, second, and third image data, respectively, a first correcting unit which compares the first sub image data, corrects the first sub second image data according to the comparison result, and outputs corrected first sub second image data, and a second correcting unit which compares the second sub image data, corrects the second sub second image data according to the comparison result, and outputs corrected second sub second image data.

19 Claims, 7 Drawing Sheets

SIGNAL PROCESSING DEVICE, LIQUID CRYSTAL DISPLAY HAVING THE SAME AND METHOD OF MANUFACTURING THE SAME

This application claims priority to Korean Patent Application No. 10-2006-0054072, filed on Jun. 15, 2006, and all the benefits accruing therefrom under 35 U.S.C. §119, the contents of which in its entirety are herein incorporated by reference.

BACKGROUND OF THE INVENTION

1. Field of the Invention

The present invention relates to a signal processing device, a liquid crystal display ("LCD") having the same and a method of manufacturing the same, and more particularly, to a signal processing device capable of improving display quality and a liquid crystal display ("LCD") having the same.

2. Description of the Related Art

In general, liquid crystal displays ("LCDs") have a narrow viewing angle. To address this problem, LCDs having a wide viewing angle in a patterned vertical alignment ("PVA") mode, a multi-domain vertical alignment ("MVA") mode, and a super-patterned vertical alignment ("S-PVA") mode have been developed.

In particular, an S-PVA mode LCD includes a pixel comprising two subpixels. Different data voltages are applied to each of the subpixels so that transmissivity of light differs in each of the subpixels, and the pixel including the two subpixels appears as a middle value between two different transmissivity values. A lateral viewing angle of an LCD can be enlarged using the S-PVA mode.

However, the S-PVA mode LCD has problems in improving the response speed of a liquid crystal, and the response speed of the liquid crystal is a factor which affects display quality of an LCD. A slow response speed may lead to blurring of moving images, otherwise known as ghosting.

Accordingly, a signal processing device capable of improving display quality by increasing the response speed of the liquid crystal and an LCD having the same are needed.

BRIEF SUMMARY OF THE INVENTION

The present invention provides a signal processing device capable of improving display quality.

The present invention also provides a liquid crystal display ("LCD") capable of improving display quality.

The present invention also provides a method manufacturing a signal processing device capable of improving display quality.

These and other aspects of the present invention will be described in or be apparent from the following description of the exemplary embodiments.

According to an exemplary embodiment of the present invention, there is provided a signal processing device. The signal processing device includes; a converting unit which converts first, second, and third image data of three consecutive frames into first sub first image data, first sub second image data, and first sub third image data having gray levels higher than the gray levels of first, second, and third image data, respectively, and second sub first image data, second sub second image data, and second sub third image data having gray levels lower than the gray levels of the first, second, and third image data, respectively, a first correcting unit which compares the first sub first image data, the first sub second image data, and the first sub third image data, corrects the first sub second image data according to the comparison result, and outputs corrected first sub second image data, and a second correcting unit which compares the second sub first image data, the second sub second image data, and the second sub third image data, corrects the second sub second image data according to the comparison result, and outputs corrected second sub second image data.

According to another exemplary embodiment of the present invention, there is provided a liquid crystal display including; a signal processing device which converts first, second, and third image data of three consecutive frames into corrected first sub second image data and corrected second sub second image data, wherein the signal processing device includes a converting unit which converts the first, second, and third image data into first sub first image data, first sub second image data, and first sub third image data having gray levels higher than the gray levels of first, second, and third image data, respectively, and second sub first image data, second sub second image data, and second sub third image data having gray levels lower than the gray levels of the first, second, and third image data, respectively; a first correcting unit which compares the first sub first image data, the first sub second image data, and the first sub third image data, corrects the first sub second image data according to the comparison result, and outputs corrected first sub second image data, and a second correcting unit which compares the second sub first image data, the second sub second image data, and the second sub third image data, corrects the second sub second image data according to the comparison result, and outputs corrected second sub second image data, a data driver which outputs a first data voltage corresponding to the corrected first sub second data and a second data voltage corresponding to the corrected second sub second data, a gate driver which outputs one of an on and off gate voltage, and a display unit comprising a plurality of pixels, each of the pixels including a first subpixel to which the first data voltage is input and a second subpixel to which the second data voltage is input.

According to still another exemplary embodiment of the present invention, there is provided a method of manufacturing a signal processing device, the method including; forming a converting unit which converts first, second, and third image data of three consecutive frames into first sub first image data, first sub second image data, and first sub third image data having gray levels higher than the gray levels of first, second, and third image data, respectively, and second sub first image data, second sub second image data, and second sub third image data having gray levels lower than the gray levels of the first, second, and third image data, respectively, connecting a first correcting unit to the converting unit, wherein the first converting unit compares the first sub first image data, the first sub second image data, and the first sub third image data, corrects the first sub second image data according to the comparison result, and outputs corrected first sub second image data, and connecting a second correcting unit to the converting unit, wherein the second converting unit compares the second sub first image data, the second sub second image data, and the second sub third image data, which corrects the second sub second image data according to the comparison result, and outputs corrected second sub second image data.

BRIEF DESCRIPTION OF THE DRAWINGS

The above and other aspects, features and advantages of the present invention will become more apparent by describing in more detail exemplary embodiments thereof with reference to the attached drawings in which.

DETAILED DESCRIPTION OF THE INVENTION

Figure 1:
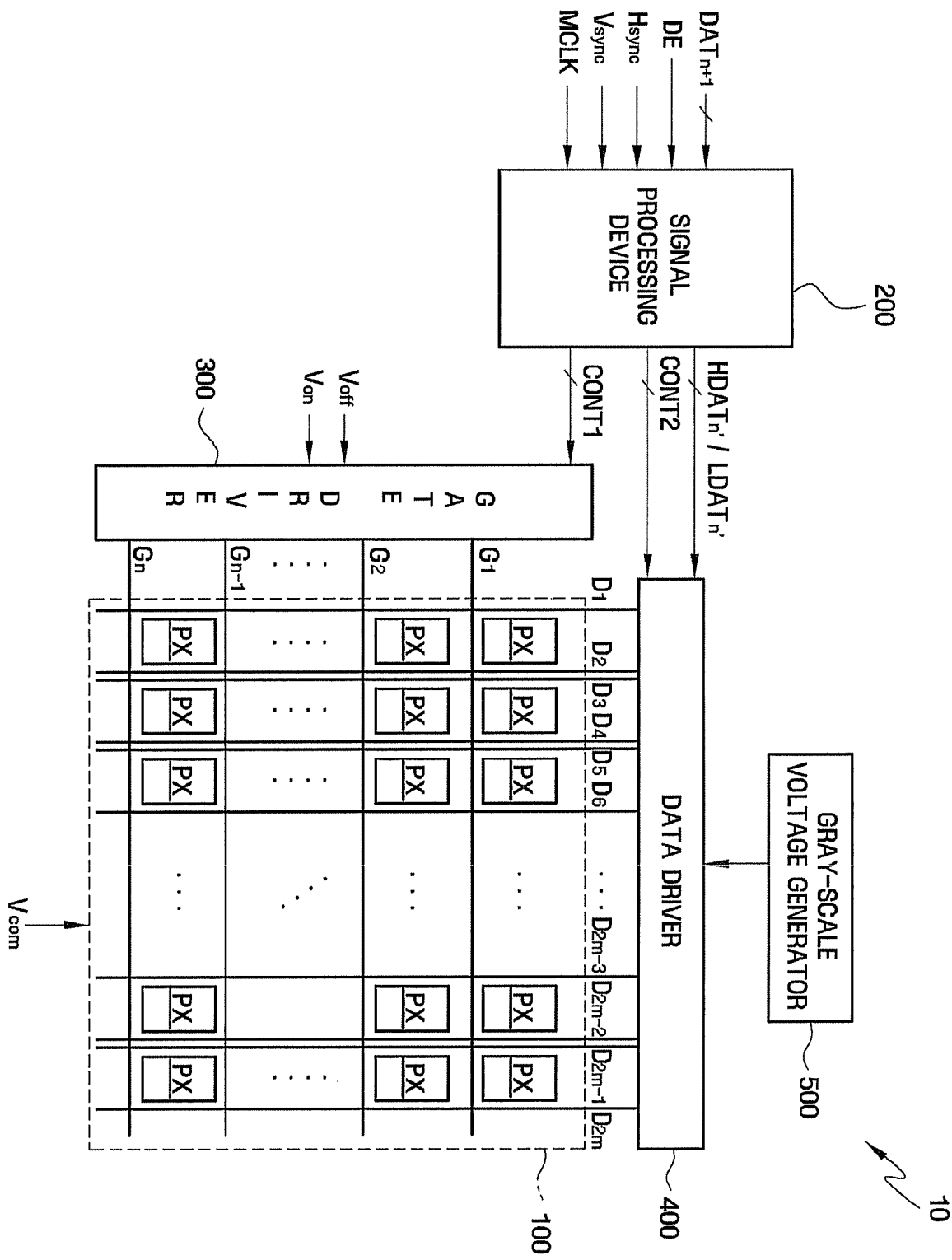
FIG. 1 is a block diagram of an exemplary embodiment of a liquid crystal display ("LCD") according to the present invention.

The present invention will now be described more fully hereinafter with reference to the accompanying drawings, in which exemplary embodiments of the present invention are shown. This invention may, however, be embodied in many different forms and should not be construed as limited to the embodiments set forth herein. Rather, these exemplary embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

The present invention will now be described more fully with reference to the accompanying drawings, in which exemplary embodiments of the present invention are shown.

Figure 2:
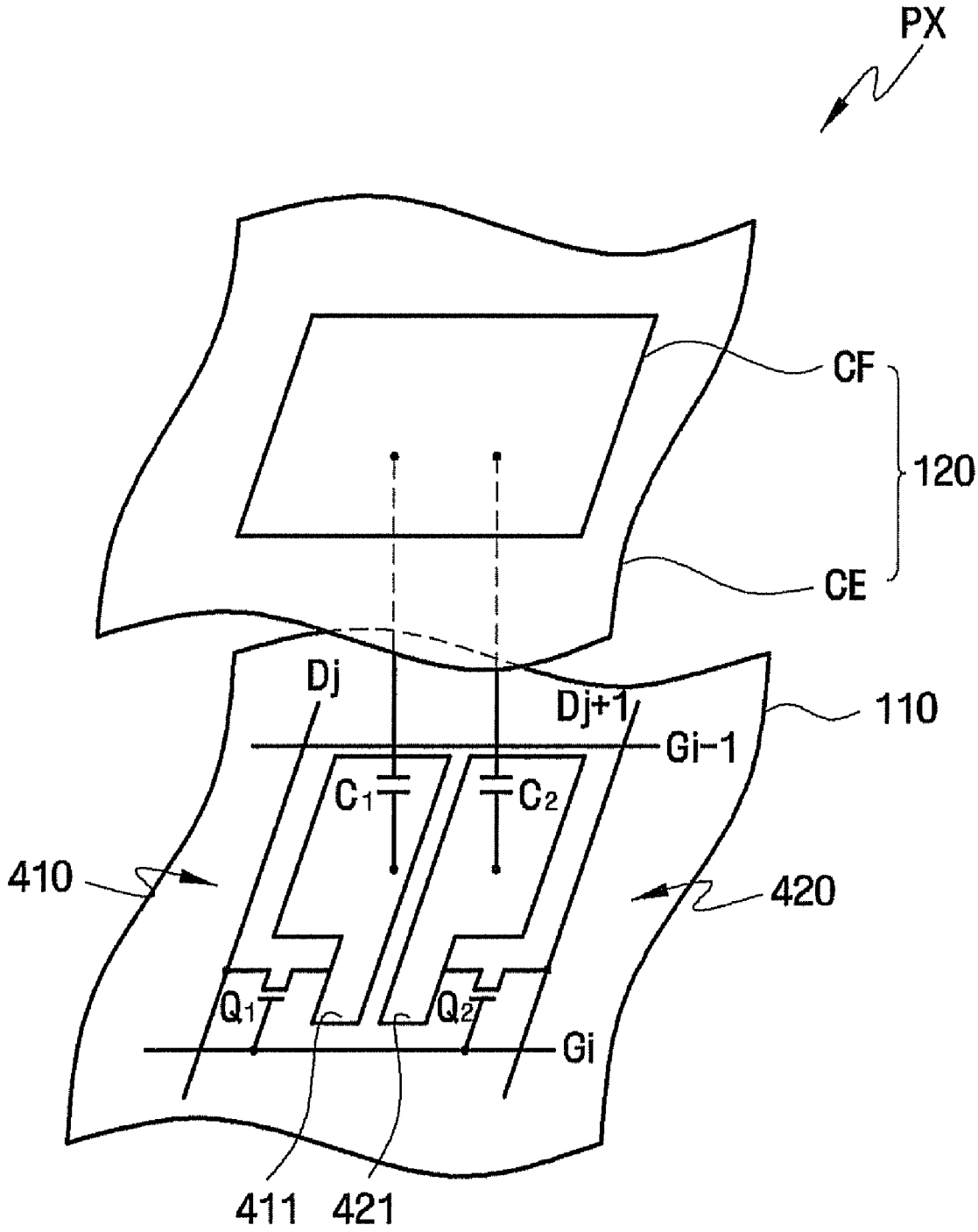
FIG. 2 is an equivalent circuit schematic diagram of one pixel of the exemplary embodiment of an LCD shown in FIG. 1.

FIG. 1 is a block diagram of an exemplary embodiment of a liquid crystal display ("LCD") according to the present invention, and FIG. 2 is an equivalent circuit diagram of one pixel of the exemplary embodiment of an LCD shown in FIG. 1. In the following description three sets of image data will be described, each set of image data comings from a later consecutive point in time. First image data is image data at an (n−1)-th frame, second image data is image data at an n-th frame, and third image data is image data at an (n+1)-th frame.

Referring to FIG. 1, an LCD 10 includes a display unit 100, a signal processing device 200, a gate driver 300, a data driver 400, and a gray-scale voltage generator 500.

The display unit 100 includes a plurality of pixels PX, a plurality of gate lines $G_1$-$G_n$, and a plurality of data lines $D_1$-$D_{2m}$.

On and off gate voltages $V_{on}$ and $V_{off}$ outputted from the grate driver 300 are applied to the plurality of gate lines $G_1$-$G_n$. Data voltages outputted from the data driver 400 are applied to the plurality of data lines $D_1$-$D_{2m}$. The gate lines G1-Gn are parallel or essentially parallel to one another, and the data lines $D_1$-$D_{2m}$, two of which are provided per a column of pixels PX, extend in a column direction substantially perpendicular to the gate lines.

Referring to FIG. 2, one pixel PX includes a first subpixel 410 and a second subpixel 420. The first subpixel 410 and the second subpixel 420 are formed between a first substrate 110 in which a first pixel electrode 411 and a second pixel electrode 421 are formed and a second substrate 120 in which a common electrode CE and a color filter CF are formed. In addition, first and second data lines $D_j$ and $D_{j+1}$ and a gate lines $G_i$ and $G_{i-1}$ are provided.

A first data voltage and second data voltage are applied to the pixel PX which is having the first subpixel 410 and the second subpixel 420. The first data voltage is a voltage which corresponds to corrected first sub second image data $HDAT_{n'}$ output by the signal processing device 200 of FIG. 1, and the second data voltage is a voltage which corresponds to corrected second sub second image data $LDAT_{n''}$. Here, the first data voltage is substantially larger than the second data voltage.

The first subpixel 410 includes a first switching element $Q_1$ which is turned on by a voltage supplied to its control terminal, which is connected to a gate line. When turned on, the first switching element $Q_1$ provides a first data voltage to a first capacitor $C_1$ which is charged with the first data voltage. The second subpixel 420 includes a second switching element $Q_2$ which is turned on by a voltage supplied to its control terminal, which is connected to another gate line. When turned on, the second switching element $Q_2$ provides a second data voltage to a second capacitor $C_2$, which is charged with the second data voltage.

If the first data voltage is applied to the first subpixel 410, light provided from a backlight assembly (not shown) is transmitted according to a first transmissivity corresponding to the first data voltage. The light transmissivity of the first subpixel is controlled by adjusting the degree to which a layer of liquid crystal, which is disposed between the first substrate and the second substrate, is twisted or vertically arranged. The liquid crystal in the liquid crystal layer may be twisted at an angle to the direction of polarization of incoming light to allow differing amounts of the incoming light to pass therethrough. When a larger voltage is applied to the liquid crystal a larger angle of twist results until a certain limit, inherent to the structure of the liquid crystal, is reached at which point the liquid crystal reaches a maximum angle of twist. If the second data voltage, which is lower than the first data voltage, is applied to the second subpixel 420, light provided from a backlight assembly (not shown) is transmitted according to a second transmissivity corresponding to the second data voltage. Accordingly, an image displayed in the pixel PX is shown with a brightness corresponding to a transmissivity between the first transmissivity and the second transmissivity.

The shapes of the first pixel electrode 411 and the second pixel electrode 421 shown in FIG. 2 are exemplary embodiments only and alternative exemplary embodiments may include configurations having other various shapes.

Referring to FIG. 1, the signal processing device 200 receives an input control signal from an external graphic controller (not shown), generates a gate control signal CONT1 and a data control signal CONT2 based on the input control signal, and transmits the gate control signal CONT1 to the gate driver 300 and the data control signal CONT2 to the data driver 400. Exemplary embodiments of the input control signal include a vertical synchronous signal $V_{sync}$, a horizontal synchronous signal $H_{sync}$, a main clock signal MCLK and a data enable signal DE.

The gate control signal CONT1 is a signal for controlling the operation of the gate driver 300 and includes a vertical start signal for starting the operation of the gate driver 300, a gate clock signal for determining a time for outputting the on gate voltage, and an output enable signal for determining a pulse width of the on gate voltage.

The data control signal CONT2 is a signal for controlling the operation of the data driver 400 and includes a horizontal start signal for starting the operation of the data driver 400 and an output enabling signal for enabling an output of two data voltages.

In addition, the signal processing device 200 receives third image data $DAT_{n+1}$ and outputs corrected first sub second image data $HDAT_{n'}$ and corrected second sub second image data $LDAT_{n''}$. Here, the corrected first sub second image data $HDAT_{n'}$ and the corrected second sub second image data $LDAT_{n''}$ are outputted when the third image data $DAT_{n+1}$, the second image data inputted before a first frame, and first image data inputted before a second frame are converted. The internal circuit of the signal processing device 200 will be described later with reference to FIG. 3.

The gate driver 300 sequentially outputs the on and off gate voltage $V_{on}$ and $V_{off}$ to the plurality of gate lines $G_1$-$G_n$ in response to the gate control signal CONT1 provided from the signal processing device 200.

The data driver 400 sequentially receives the corrected first sub second image data $HDAT_{n'}$ and the corrected second sub second image data $LDAT_{n''}$ in response to the data control signal CONT2 provided from the signal processing device 200.

Further, the data driver 400 selects a gray-scale voltage corresponding to the corrected first sub second image data $HDAT_{n'}$ from a plurality of gray-scale voltages provided from the gray-scale voltage generator 500 and applies the gray-scale voltage to a first data line $D_j$ provided at the first subpixel 410 of FIG. 2, and selects a gray-scale voltage corresponding to the corrected second sub second image data $LDAT_{n''}$ and applies the gray-scale voltage to a second data line $D_{j+1}$ provided at the second subpixel 420 of FIG. 2.

Meanwhile, an exemplary embodiment of the gray-scale voltage generator 500 includes a plurality of resistors (not shown) connected in series between a node, to which a driving voltage is applied, and a ground. The gray-scale voltage generator 500 generates a plurality of gray-scale voltages (not shown) by distributing a voltage level of the driving voltage. Alternative exemplary embodiments of gray-scale voltage generators include configurations wherein the internal circuits have various structures.

In the exemplary embodiment of an LCD 10, the response speed of liquid crystals of the first and second subpixels 410 and 420 is increased so that display quality is improved. An exemplary embodiment of a signal processing device 200 for providing this effect will now be described in greater detail.

Figure 3:
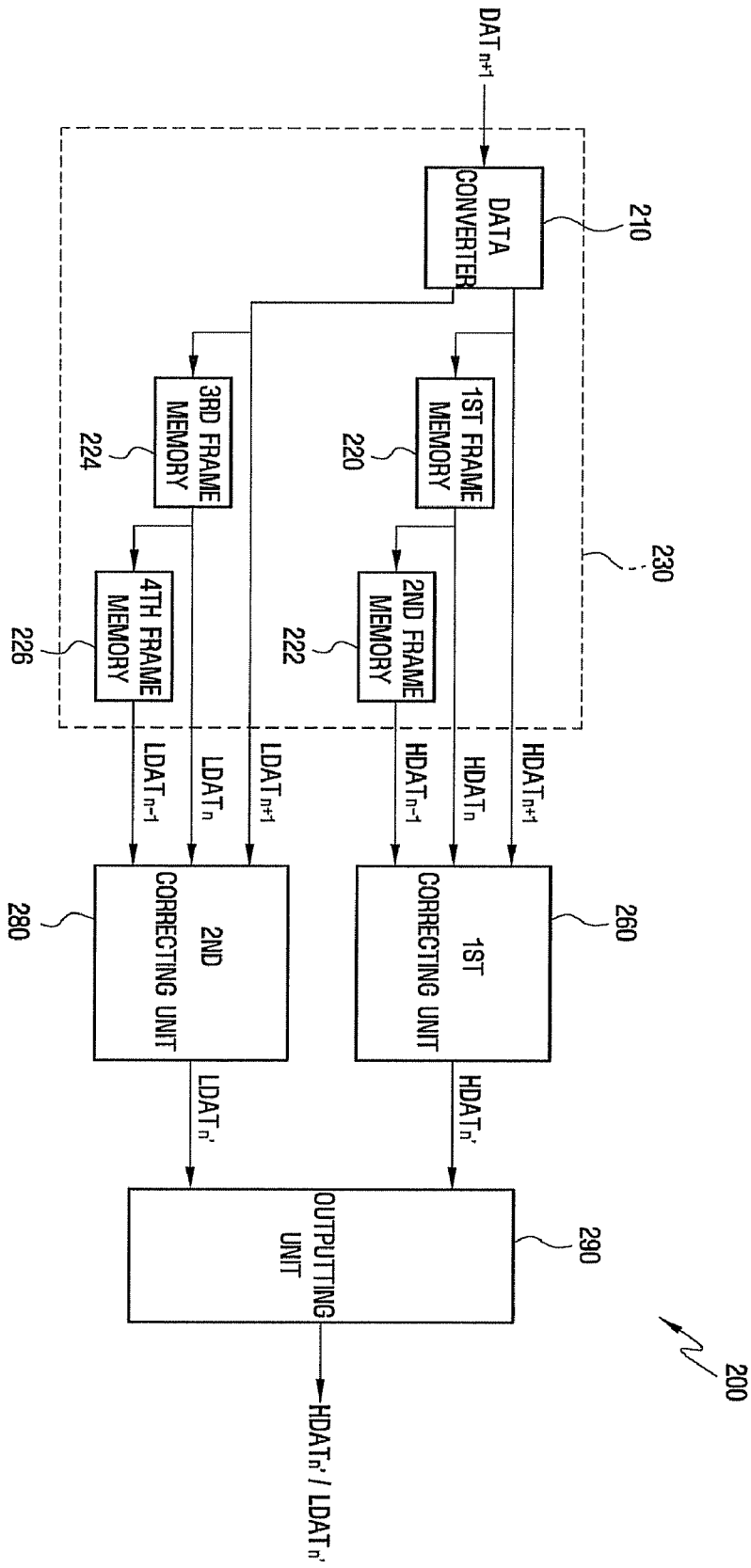
FIG. 3 is a block diagram of a portion of an exemplary embodiment of a signal processing device according to the present invention.

FIG. 3 is a block diagram of an exemplary embodiment of a portion of a signal processing device according to the present invention.

Referring to FIG. 3, the signal processing device 200 includes a converting unit 230, a first correcting unit 260, a second correcting unit 280, and an outputting unit 290.

The converting unit 230 converts first, second, and third image data $DAT_{n-1}$, $DAT_n$, and $DAT_{n+1}$ of three consecutive frames into first sub first image data, first sub second image data, and first sub third image data $HDAT_{n-1}$, $HDAT_n$, and $HDAT_{n+1}$ having gray levels higher than the gray levels of first, second, and third image data $DAT_{n-1}$, $DAT_n$, and $DAT_{n+1}$, respectively. The converting unit 230 also converts the first, second and third image data $DAT_{n-1}$, $DAT_n$, and $DAT_{n+1}$ into second sub first image data, second sub second image data, and second sub third image data $LDAT_{n-1}$, $LDAT_n$, and $LDAT_{n+1}$ having gray levels lower than the gray levels of the first, second, and third image data $DAT_{n-1}$, $DAT_n$, and $DAT_{n+1}$, respectively.

Specifically, the converting unit 230 includes a data converter 210 and first through fourth frame memories 220, 222, 224, and 226.

The data converter 210 converts the third image data $DAT_{n+1}$ into first sub third image data $HDAT_{n+1}$ having a gray level higher than the third image data $DAT_{n+1}$ and second sub third image data $LDAT_{n+1}$ having gray level lower than the third image data $DAT_{n+1}$. The operation of the data converter 210 will be described later with reference to FIGS. 4 and 5.

The first through fourth frame memories 220, 222, 224, and 226 provide data $HDAT_{n-1}$, $HDAT_n$, $HDAT_{n+1}$, $LDAT_{n-1}$, $LDAT_n$, and $LDAT_{n+1}$ of three consecutive frames.

Specifically, the first frame memory 220 receives the first sub third image data $HDAT_{n+1}$ from the data converter 210, stores it, and outputs the first sub second image data $HDAT_n$. The second frame memory 222 receives the first sub second image data $HDAT_n$ from the first frame memory 220, stores it, and outputs the first sub first image data $HDAT_{n-1}$.

In addition, the third frame memory 224 receives the second sub third image data $LDAT_{n+1}$ from the data converter 210, stores it, and outputs the second sub second image data $LDAT_n$. The fourth frame memory 226 receives the second sub second image data $LDAT_n$ from the third frame memory 224, stores it, and outputs the second sub first image data $LDAT_{n-1}$.

Here, the first sub second image data $HDAT_n$ and the first sub third image data $HDAT_{n+1}$ are data having a gray level higher than the gray levels of the second image data $DAT_n$ and the third image data $DAT_{n+1}$, respectively, and the second sub second image data $LDAT_n$ and the second sub third image data $LDAT_{n+1}$ are data having a gray level lower than the gray levels of the second image data $DAT_n$ and the third image data $DAT_{n+1}$, respectively. The data are generated when the second image data $DAT_n$ and the third image data $DAT_{n+1}$ are converted by the data converter 210.

The first correcting unit 260 compares the first sub third image data $HDAT_{n+1}$, the first sub second image data $HDAT_n$, and the first sub first image data $HDAT_{n-1}$, corrects the first sub second image data $HDAT_n$ according to a comparison of the three first sub image data, and outputs the corrected first sub second image data $HDAT_{n'}$. The operation of the first correcting unit 260 will be described later with reference to FIG. 6.

The second correcting unit 280 compares the second sub third image data $LDAT_{n+1}$, the second sub second image data $LDAT_n$, and the second sub first image data $LDAT_{n-1}$, corrects the second sub second image data $LDAT_n$ according to a comparison of the three second sub image data, and outputs the corrected second sub second image data $LDAT_{n'}$. The operation of the second correcting unit 280 will be described later with reference to FIG. 7.

The outputting unit 290 receives the corrected first sub second image data $HDAT_{n'}$ from the first correcting unit 260 and receives the corrected second sub second image $LDAT_{n'}$ from the second correcting unit 280. The outputting unit 290 then outputs the corrected first sub second image data $HDAT_{n'}$ and the corrected second sub second image $LDAT_{n'}$.

The signal processing device 200 will now be described in more detail with reference to FIGS. 4 and 5.

Figure 4:
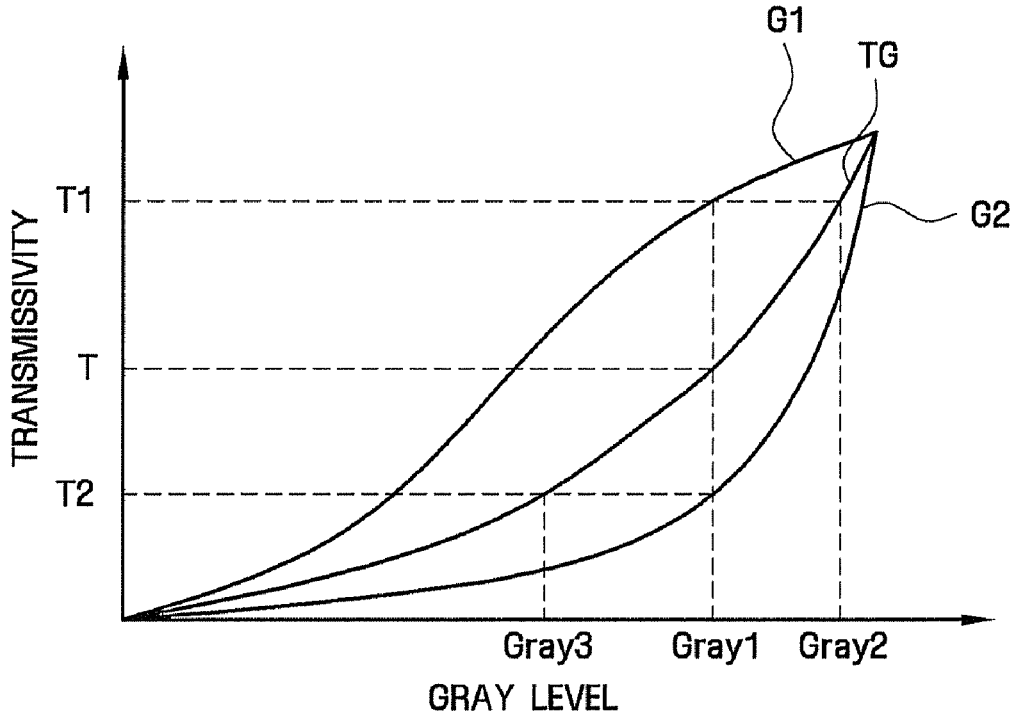
FIG. 4 is a graph showing the transmissivity and gray level of an exemplary embodiment of the data converter as shown in FIG. 3.
Figure 5:
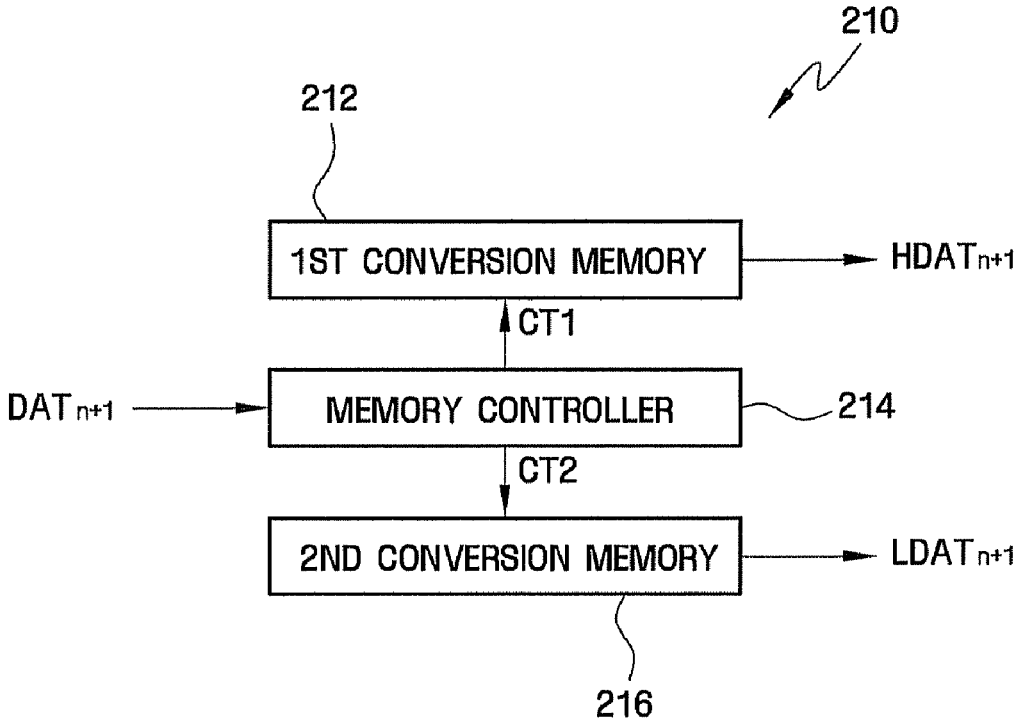
FIG. 5 is a block diagram of the exemplary embodiment of the data converter as shown in FIG. 3.

FIG. 4 is a graph showing the transmissivity and gray level of an exemplary embodiment of the data converter 210 as shown in FIG. 3. FIG. 5 is a block diagram of the exemplary embodiment of the data converter 210 as shown in FIG. 3.

Referring to FIG. 4, the x-axis represents gray level and the y-axis represents transmissivity. In addition, a target gamma curve TG represents transmissivity corresponding to a gray of third image data $DAT_{n+1}$, a first conversion gamma curve G1 represents transmissivity which is the same as or larger than transmissivity of the target gamma curve TG at the same gray, and a second conversion gamma curve G2 represents transmissivity which is the same as or smaller than transmissivity of the target gamma curve TG at the same gray. Here, the first conversion gamma curve G1 and the second conversion gamma curve G2 are used to convert the third image data $DAT_{n+1}$ into first sub third image data $HDAT_{n+1}$ and second sub third image data $LDAT_{n+1}$.

For example, when an image is shown with a target transmissivity T in the pixel PX of FIG. 2, the transmissivity of light at a first subpixel 410 may be set to a first transmissivity T1 which is higher than the target transmissivity T, and the transmissivity of light at a second subpixel 420 may be set to a second transmissivity T2 which is lower than the target transmissivity T.

A voltage corresponding to a second gray Gray2 corresponding to the first transmissivity T1 should be applied to the first subpixel 410 and a voltage corresponding to a third gray Gray3 corresponding to the second transmissivity T2 should be applied to the second subpixel 420. The combined effect of applying the higher voltage to the first subpixel 410 and the lower voltage to the second subpixel 420 is as a single voltage corresponding to a gray level Gray1 had been applied to the entire pixel $PX_{[JSY1]}$.

Accordingly, the data converter 210 converts the third image data $DAT_{n+1}$ into first sub third image data $HDAT_{n+1}$ corresponding to the second gray Gray2 and second sub third image data $LDAT_{n+1}$ corresponding to the third gray Gray3.

The first conversion gamma curve G1 and the second conversion gamma curve G2 may be arbitrarily set so that the transmissivity of the pixel is the target transmissivity T. The values of the first transmissivity T1 and the second transmissivity T2 may be set to various values, so that the transmissivity of the pixel PX including the first subpixel 410 having the first transmissivity T1 and the second subpixel 420 having the second transmissivity T2 is the target transmissivity T.

The internal construction of the data converter 210 will now be described with reference to FIG. 5. Referring to FIG. 5, the data converter 210 may include a memory controller 214 and first and second conversion memories 212 and 216.

As described previously with reference to FIG. 4, after the first conversion gamma curve (see G1 of FIG. 4) and the second conversion gamma curve (see G2 of FIG. 4) are set, the first sub third image data $HDAT_{n+1}$ and the second sub third image data $LDAT_{n+1}$ which correspond to the third image data $DAT_{n+1}$ can be determined. Accordingly, prior to the operating of the signal processing device 200, the predetermined first sub third image data $HDAT_{n+1}$ and second sub third image data $LDAT_{n+1}$ are stored in the first conversion memory 212 and the second conversion memory 216.

When the third image data $DAT_{n+1}$ is inputted to the data converter 210, the memory controller 214 provides a first control signal CT1 and a second control signal CT2 to the first conversion memory 212 and the second conversion memory 216, respectively. The first control signal CT1 and the second control signal CT2 each include a read command signal and an address signal. The address signal may be the same as the third image data DATn+1.

The first conversion memory 212 and the second conversion memory 216 output the first sub third image data HDATn+1 and the second sub third image data LDATn+1 in response to the first and second control signals CT1 and CT2.

Figure 6:
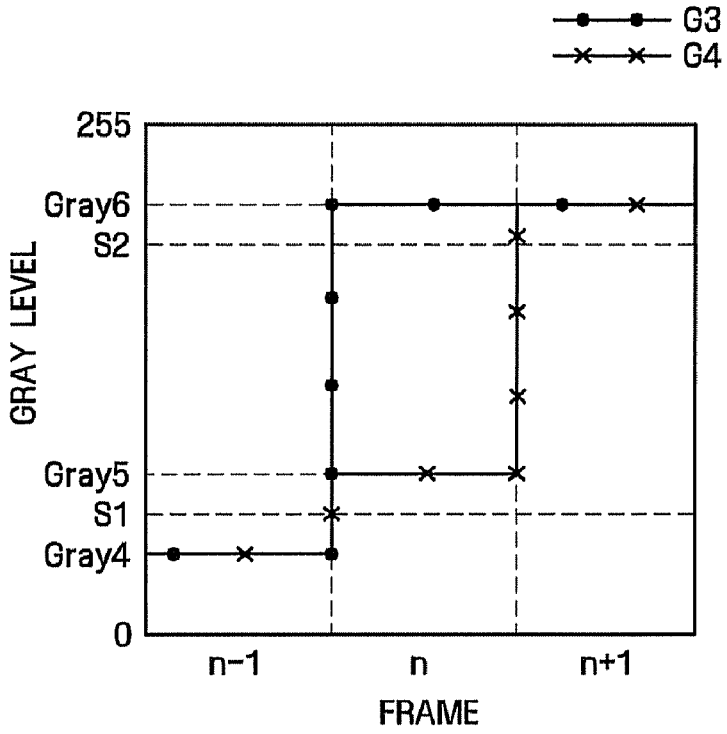
FIG. 6 is a graph showing the gray level and frame number of an exemplary embodiment of a first correcting unit as shown in FIG. 3.
Figure 7:
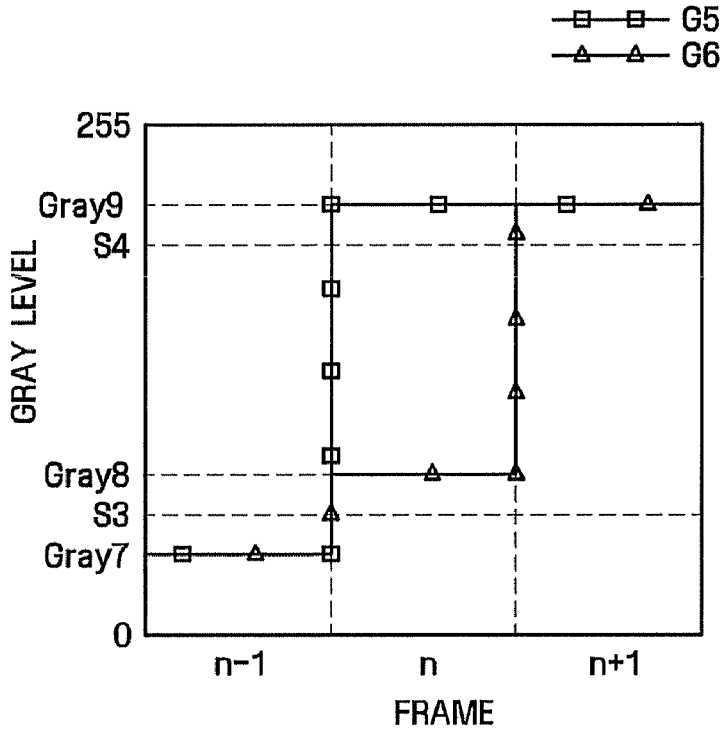
FIG. 7 is a graph showing the gray level and frame number of an exemplary embodiment of a second correcting unit as shown in FIG. 3.

FIG. 6 is a graph showing the gray level and frame number of an exemplary embodiment of a first correcting unit 260 as shown in FIG. 3, and FIG. 7 is a graph showing the gray level and frame number of an exemplary embodiment of a second correcting unit 280 as shown in FIG. 3.

Referring to FIG. 6, the x-axis represents frame number, the y-axis represents gray level, a line G3 represents gray levels of data inputted to the first correcting unit 260 as shown in FIG. 3, and a line G4 represents gray levels of data outputted from the first correcting unit 260 as shown in FIG. 3. The exemplary embodiment wherein there are 256 gray levels will now be described.

TABLE 1

| | | | |
|---|---|---|---|
| Before correcting | $HDAT_{n-1} < S1$ | $S2 < HDAT_n$ | $S2 < HDAT_{n+1}$ |
| After correcting | | $S1 < HDAT_{n'} < S2$ | |

First, the operation of the first correcting unit 260 will now be described with reference to Table 1. As shown in Table 1, before correcting, when the gray level of the first sub first image data $HDAT_{n-1}$ at an (n−1)-th frame is smaller than a first reference value S1, the gray level of the first sub second image data $HDAT_n$ at an n-th frame is larger than a second reference value S2 and the gray level of the first sub third image data $HDAT_{n+1}$ at an (n+1)-th frame is larger than the second reference value S2, the first correcting unit 260 corrects the first sub second image data $HDAT_n$ and outputs the corrected first sub second image data $HDAT_{n'}$, which is larger than the first reference value S1 and smaller than the second reference value S2.

Referring to the line G3 of FIG. 6, a fourth gray level Gray4 input to the first correcting unit 260 at the (n−1)-th frame is smaller than the first reference value S1, and a sixth gray level Gray6 input to the first correcting unit 260 at the n-th frame and at the (n+1)-th frame is larger than the second reference value S2.

According to the line G4, in the frame n the first correcting unit 260 outputs the corrected first sub second image data $HDAT_{n'}$ at a fifth gray level Gray5 which is larger than the first reference value S1 and smaller than the second reference value S2.

When there is a large difference between the fourth gray level Gray4 of the first sub first image data $HDAT_{n-1}$ and the sixth gray level Gray6 of the first sub third image data $HDAT_{n+1}$, if the corrected first sub second image data $HDAT_{n'}$ having the fifth gray level Gray5 between the first reference value S1 and the second reference value S2 is applied to the first subpixel 410, a liquid crystal of the first subpixel 410 is pre-tilt. The fifth gray level Gray5 acts as an intermediate step between Gray4 and Gray6. Accordingly, even when data of the sixth gray level Gray6 is applied to the first subpixel 410 at the (n+1) frame, the liquid crystal of the first subpixel 410 is rapidly pre-tilt so that the first subpixel 410 has transmissivity corresponding to the sixth gray level Gray6. The response speed of the liquid crystal can be increased and display quality of the LCD 10 can be improved.

Referring to the fourth line G4, the gray level of the data output from the first correcting unit 260 at the (n+1)-th frame is the sixth gray level Gray6. However, the first correcting unit 260 may also output data of the gray level which is larger than the sixth gray level Gray6. In addition, the first and second reference values S1 and S2 may be set in various ways according to properties of the LCD (see 10 of FIG. 1).

Referring to FIG. 7, the x-axis represents frame number, the y-axis represents gray level, the fifth line G5 represents gray levels of data inputted to the second correcting unit 280, and the sixth line G6 represents gray levels of data outputted from the second correcting unit 280. The exemplary embodiment wherein the gray scale has 256 gray levels will now be described.

Like the first correcting unit 260, if in three consecutive frames, a seventh gray level Gray7, corresponding to the second sub first image data $LDAT_{n-1}$, is smaller than a third reference value S3; and a ninth gray level Gray9, corresponding to the gray level of the second sub second image data $LDAT_n$ and the gray level of the second sub third image data $LDAT_{n+1}$, is larger than a fourth reference value S4, then the second correcting unit 280 outputs the corrected second sub second image data $LDAT_{n'}$ having an eighth gray level Gray8 between the third reference value S3 and the fourth reference value S4.

The second correcting unit 280 improves the response speed of the liquid crystal of the second subpixel 420. Here, the third reference value S3 and the fourth reference value S4 may be set in various ways according to properties of the LCD 10 and may be different from the first and second reference values S1 and S2.

Accordingly, the first subpixel 410 and the second subpixel 420 are applied by the fifth gray level Gray5 and the eighth gray level Gray8 at the n frame, respectively. Each subpixel has different pre-tilt level voltages. Namely, the first subpixel 410 has higher level of a voltage than the second subpixel 420. Thus, a response speed of the liquid crystals can be improved and faster and display quality of an LCD can be improved As described above, the signal processing device 200 converts data at three consecutive frames into two subdata, respectively, compares the converted subdata to previous frames, corrects each of the subdata according to the comparison result, and applies the corrected subdata to the first subpixel 410 and the second subpixel 420.

The signal processing device 200 converts and corrects data so that the response speed of liquid crystals of the first subpixel 410 and the second subpixel 420 can be increased and provides the converted and corrected data to the first and second subpixels 410 and 420. The signal processing device 200 increases the response speed of a pixel, and a pixel has exact transmissivity corresponding to data applied to the pixel. Accordingly, the display quality of an LCD is improved.

Figure 8:
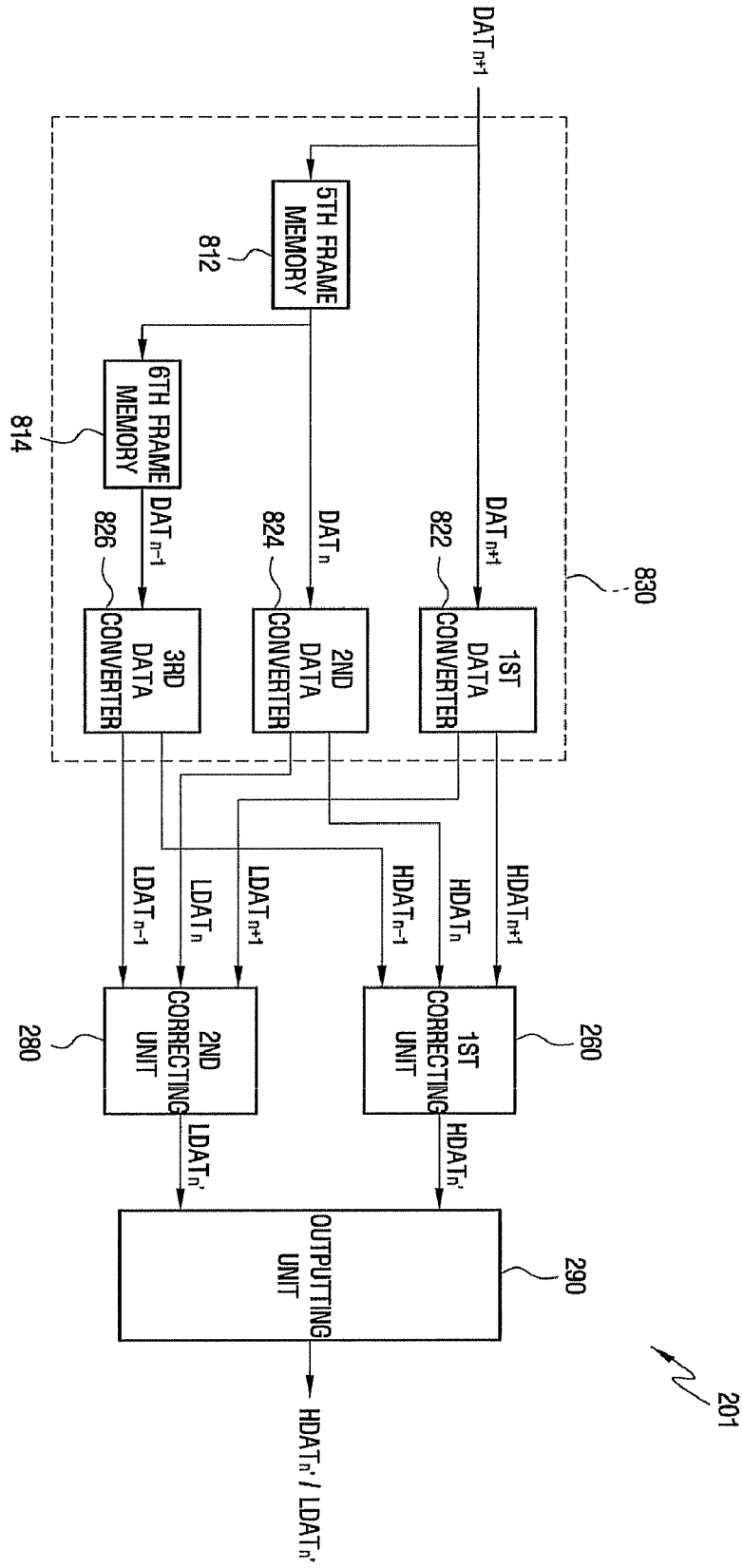
FIG. 8 is a block diagram of an exemplary embodiment of a signal processing device according to the present invention.

FIG. 8 is a block diagram of an exemplary embodiment of a signal processing device according to the present invention. For brevity, components having substantially the same function as the exemplary embodiment shown in FIG. 3 are identified by the same reference numerals, and detailed descriptions thereof will be omitted.

Referring to FIG. 8, a signal processing device 201 includes a converting unit 830 having fifth and sixth frame memories 812 and 814 and first through third data converters 822, 824, and 826.

The fifth frame memory 812 receives third image data $DAT_{n+1}$, stores it, and outputs second image data $DAT_n$. The sixth frame memory 814 receives second image data $DAT_n$, stores it, and outputs first image data $DAT_{n-1}$.

The first data converter 822 converts the third image data $DAT_{n+1}$ into first sub third image data $HDAT_{n+1}$ having a gray level which is higher than that of the third image data $DAT_{n+1}$ and second sub third image data $LDAT_{n+1}$ of the gray level which is lower than that of the third image data $DAT_{n+1}$. The second data converter 824 converts the second image data $DAT_n$ into first sub second image data $HDAT_n$ having a gray level which is higher than that of the second image data $DAT_n$ and second sub second image data $LDAT_n$ having a gray level which is lower than that of the second image data $DAT_n$. The third data converter 826 converts the first image data $DAT_{n-1}$ into first sub first image data HDATn−1having a gray level which is higher than that of the first image data DATn−1 and second sub first image data LDATn−1 having a gray level which is lower than that of the first image data DATn−1. Here, the first through third data converters 822, 824, and 826 each operate in a similar manner as the data converter 210 of FIG. 3.

Thus, the current exemplary embodiment of a signal processing device 201 provides first sub second correcting data HDATn' and second sub second correcting data LDATn' which respectively pre-tilt liquid crystals of the first subpixel 410 and the second subpixel 420. Thus, the response speed of the liquid crystals can be increased and display quality of an LCD can be improved.

Figure 9:
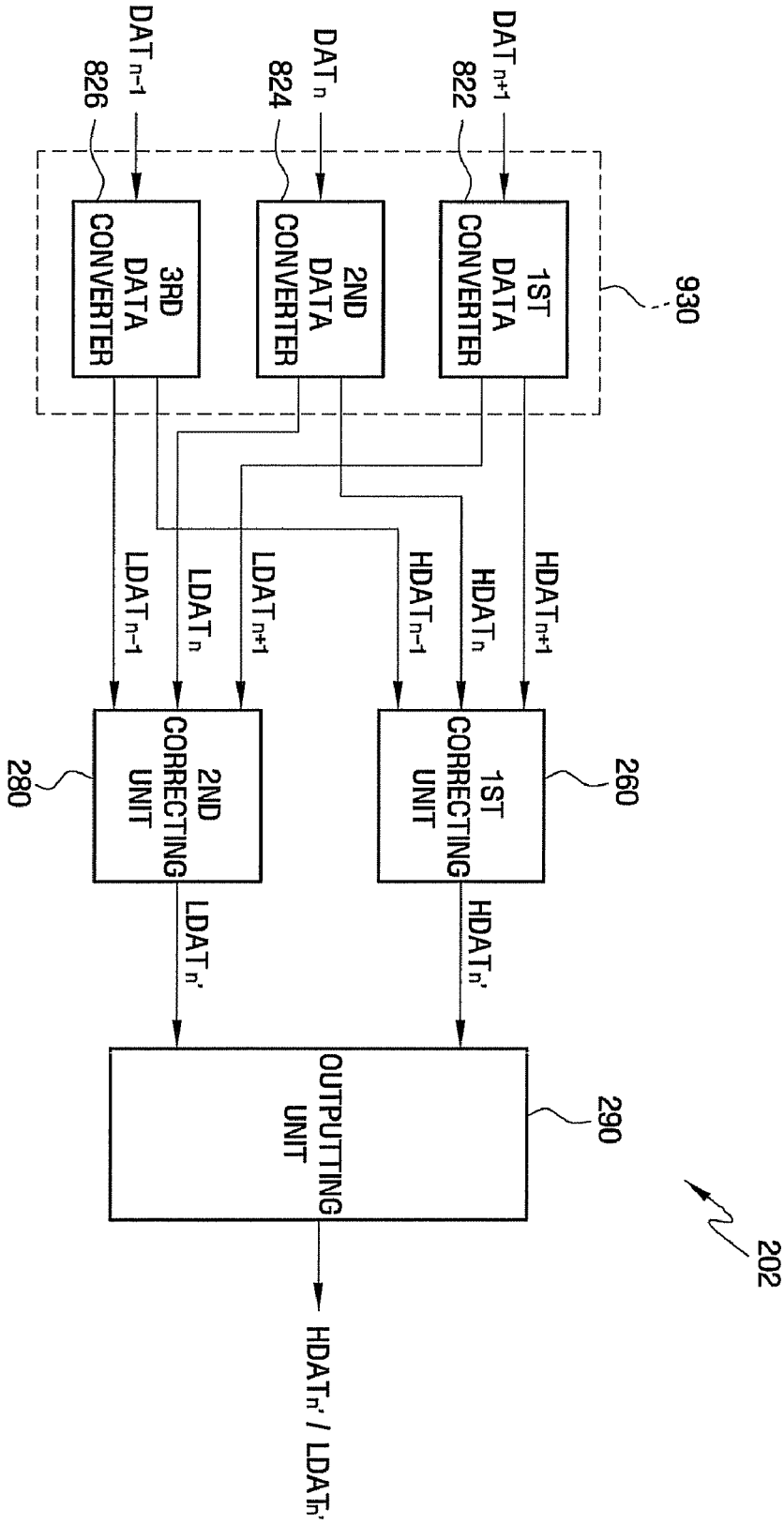
FIG. 9 is a block diagram of an exemplary embodiment of a signal processing device according to the present invention.

FIG. 9 is a block diagram of an exemplary embodiment of a signal processing device according to the present invention. For brevity, components having substantially the same function as the exemplary embodiments shown in FIGS. 3 and 8 are identified by the same reference numerals, and detailed descriptions thereof will be omitted.

Referring to FIG. 9, an exemplary embodiment of a signal processing device 202 is different from the signal processing device 201 of FIG. 8 in that the signal processing device 202 does not include a frame memory. First, second, and third image data DATn−1, DATn, and DATn+1 of three consecutive frames are provided to the converting unit 930 of the signal processing device 202 from the outside.

The signal processing device 202 also increases the response speed of liquid crystals and improves display quality of an LCD.

The signal processing device and the LCD having the same according to the present invention have the following effects.

First, the response speed of liquid crystal can be increased. Second, the response speed of the liquid crystal is increased so that display quality of the LCD is improved.

While the present invention has been particularly shown and described with reference to exemplary embodiments thereof, it will be understood by those skilled in the art that various changes in form and details may be made therein without departing from the spirit and scope of the present invention as defined by the following claims and equivalents thereof.

What is claimed is:

1. A signal processing device comprising:

a converting unit which converts first, second, and third image data of three consecutive frames into first sub first image data, first sub second image data, and first sub third image data having gray levels higher than gray levels of first, second, and third image data, respectively, and second sub first image data, second sub second image data, and second sub third image data having gray levels lower than the gray levels of the first, second, and third image data, respectively;

a first correcting unit which compares the first sub first image data, the first sub second image data, and the first sub third image data, corrects the first sub second image data according to the comparison result, and outputs corrected first sub second image data; and a second correcting unit which compares the second sub first image data, the second sub second image data, and the second sub third image data, corrects the second sub second image data according to the comparison result, and outputs corrected second sub second image data.

2. The signal processing device of claim 1, wherein a target gamma curve has a transmissivity corresponding to a gray level of an N-th image data, wherein N is an integer which represents a frame number, a first conversion gamma curve has a transmissivity which is the same as or larger than a transmissivity of the target gamma curve at the same gray level, and a second conversion gamma curve has a transmissivity which is the same as or smaller than a transmissivity of the target gamma curve at the same gray level, and wherein, a first transmissivity is a transmissivity corresponding to a gray level of the N-th image data at the first conversion gamma curve, and a second transmissivity is a transmissivity corresponding to the gray level of the N-th image data at the second conversion gamma curve, a gray level of the first sub N-th image data corresponds to the first transmissivity on the target gamma curve, and a gray level of the second sub N-th image data corresponds to the second transmissivity on the target gamma curve.

3. The signal processing device of claim 1, wherein, if a gray level of the first sub first image data is less than or equal to a first reference value and a gray level of the first sub second image data and a gray level of the first sub third image data are greater than or equal to a second reference value which is larger than the first reference value, the first correcting unit corrects the first sub second image data and outputs the corrected first sub second image data with a gray level between the first reference value and the second reference value.

4. The signal processing device of claim 1, wherein, if a gray level of the second sub first image data is less than or equal to a third reference value and a gray level of the second sub second image data and a gray level of the second sub third image data are greater than or equal to a fourth reference value which is larger than the third reference value, the second correcting unit corrects the second sub second image data and outputs the corrected second sub second image data with a gray level between the third reference value and the fourth reference value.

5. The signal processing device of claim 1, wherein the converting unit comprises:

a data converter which converts the third image data into the first sub third image data and the second sub third image data;

a first frame memory which receives and stores the first sub third image data and outputs the first sub second image data;

a second frame memory which receives and stores the first sub second image data and outputs the first sub first image data;

a third frame memory which receives and stores the second sub third image data and outputs the second sub second image data; and a fourth frame memory which receives and stores the second sub second image data and outputs the second sub first image data.

6. The signal processing device of claim 1, wherein the converting unit comprises:

a first data converter which converts the first image data into the first sub first image data and the second sub first image data;

a second data converter which converts the second image data into the first sub second image data and the second sub second image data; and a third data converter which converts the third image data into the first sub third image data and the second sub third image data.

7. The signal processing device of claim 6, wherein the converting unit further comprises:

a frame memory which receives and stores the third image data and provides the second image data to the second data converter; and another frame memory which receives and stores the second image data and provides the first image data to the first data converter.

8. The signal processing device of claim 1, further comprising an outputting unit which outputs the corrected first sub second image data and the corrected second sub second image data.

9. A liquid crystal display comprising:

a signal processing device which converts first, second, and third image data of three consecutive frames into corrected first sub second image data and corrected second sub second image data, wherein the signal processing device includes; a converting unit which converts the first, second, and third image data into first sub first image data, first sub second image data, and first sub third image data having gray levels higher than gray levels of first, second, and third image data, respectively, and second sub first image data, second sub second image data, and second sub third image data having gray levels lower than the gray levels of the first, second, and third image data, respectively, a first correcting unit which compares the first sub first image data, the first sub second image data, and the first sub third image data, corrects the first sub second image data according to the comparison result, and outputs corrected first sub second image data, and a second correcting unit which compares the second sub first image data, the second sub second image data, and the second sub third image data, corrects the second sub second image data according to the comparison result, and outputs corrected second sub second image data;

a data driver which outputs a first data voltage corresponding to the corrected first sub second image data and a second data voltage corresponding to the corrected second sub second image data;

a gate driver which outputs one of an on and off gate voltage; and a display unit comprising a plurality of pixels, each of the pixels including a first subpixel to which the first data voltage is input and a second subpixel to which the second data voltage is input.

10. The liquid crystal display of claim 9, wherein a target gamma curve has a transmissivity corresponding to a gray level of an N-th image data, wherein N is an integer representing a frame number, a first conversion gamma curve has a transmissivity which is the same as or larger than a transmissivity of the target gamma curve at the same gray level, and a second conversion gamma curve has a transmissivity which is the same as or smaller than a transmissivity of the target gamma curve at the same gray level, and wherein, a first transmissivity is a transmissivity corresponding to a gray level of the N-th image data at the first conversion gamma curve, and a second transmissivity is a transmissivity corresponding to the gray level of the N-th image data at the second conversion gamma curve, a gray level of the first sub N-th image data corresponds to the first transmissivity on the target gamma curve, and a gray level of the second sub N-th image data corresponds to the second transmissivity on the target gamma curve.

11. The liquid crystal display of claim 9, wherein, if a gray level of the first sub first image data is less than or equal to a first reference value and a gray level of the first sub second image data and a gray level of the first sub third image data are greater than or equal to a second reference value which is larger than the first reference value, the first correcting unit corrects the first sub second image data and outputs the corrected first sub second image data with a gray level between the first reference value and the second reference value.

12. The liquid crystal display of claim 9, wherein, if a gray level of the second sub first image data is less than or equal to a third reference value and a gray level of the second sub second image data and a gray level of the second sub third image data are greater than or equal to a fourth reference value which is larger than the third reference value, the second correcting unit corrects the second sub second image data and outputs the corrected second sub second image data with a gray level between the third reference value and the fourth reference value.

13. The liquid crystal display of claim 9, wherein the converting unit comprises:

a data converter which converts the third image data into the first sub third image data and the second sub third image data;

a first frame memory which receives and stores the first sub third image data and outputs the first sub second image data;

a second frame memory which receives and stores the first sub second image data and outputs the first sub first image data;

a third frame memory which receives and stores the second sub third image data and outputs the second sub second image data; and a fourth frame memory which receives and stores the second sub second image data and outputs the second sub first image data.

14. The liquid crystal display of claim 9, wherein the converting unit further comprises:

a first data converter which converts the first image data into the first sub first image data and the second sub first image data;

a second data converter which converts the second image data into the first sub second image data and the second sub second image data; and a third data converter which converts the third image data into the first sub third image data and the second sub third image data.

15. The liquid crystal display of claim 14, wherein the converting unit further comprises:

a frame memory which receives and stores the third image data and provides the second image data to the second data converter; and another frame memory which receives and stores the second image data and provides the first image data to the first data converter.

16. The liquid crystal display of claim 9, wherein the signal processing device further comprises an outputting unit which outputs the corrected first sub second image data and the corrected second sub second image data.

17. The liquid crystal display of claim 9, wherein the display unit comprises:

a first data line to which the first data voltage is applied;

a second data line to which the second data voltage is applied;

a gate line to which one of the on and off gate voltage is applied.

18. The liquid crystal display of claim 17, wherein a pixel comprises:

a first subpixel comprising; a first switching element connected to the first data line and the gate line, wherein when enabled by the on gate voltage the first switching element outputs the first data voltage, and a first capacitor in which the first data voltage is charged; and a second subpixel comprising; a second switching element connected to the second data line and the gate line, wherein when enabled by the on gate voltage the second switching element outputs the second data voltage, and a second capacitor in which the second data voltage is charged.

19. A method of manufacturing a signal processing device, the method comprising:

forming a converting unit which converts first, second, and third image data of three consecutive frames into first sub first image data, first sub second image data, and first sub third image data having gray levels higher than gray levels of first, second, and third image data, respectively, and second sub first image data, second sub second image data, and second sub third image data having gray levels lower than the gray levels of the first, second, and third image data, respectively;

connecting a first correcting unit to the converting unit, wherein the first converting unit compares the first sub first image data, the first sub second image data, and the first sub third image data, corrects the first sub second image data according to the comparison result, and outputs corrected first sub second image data; and connecting a second correcting unit to the converting unit, wherein the second converting unit compares the second sub first image data, the second sub second image data, and the second sub third image data, which corrects the second sub second image data according to the comparison result, and outputs corrected second sub second image data.

* * * * *